US006059333A

United States Patent [19]

De Toma

[11] Patent Number: 6,059,333

[45] Date of Patent: May 9, 2000

[54] DEVICE FOR THE PICKING UP OF CANINE EXCREMENT

[76] Inventor: Michele De Toma, Via Pisa 7, Trani (Bari), Italy

[21] Appl. No.: 09/271,769

[22] Filed: Mar. 18, 1999

[51] Int. Cl.[7] ..... A01K 29/00; E01H 1/12

[52] U.S. Cl. ..... 294/1.3

[58] Field of Search ..... 294/1.3–1.5, 25, 294/55, 99.2, 169; 15/257.1, 257.6, 257.7, 104.8

[56] References Cited

U.S. PATENT DOCUMENTS

| | | | |
|---|---|---|---|
| 3,767,247 | 10/1973 | Wetzler | 294/1.3 |
| 4,097,082 | 6/1978 | Orofino | 294/1.4 |
| 4,428,610 | 1/1984 | Guffey | 294/1.3 |
| 4,747,633 | 5/1988 | Stacy | 294/25 |
| 5,370,431 | 12/1994 | Henninger et al. | 294/99.2 |
| 5,385,376 | 1/1995 | Malaspina et al. | 15/257.6 |
| 5,620,220 | 4/1997 | Khoshnood | 294/1.3 |

FOREIGN PATENT DOCUMENTS

| | | | |
|---|---|---|---|
| 584040 | 2/1994 | European Pat. Off. | 294/1.3 |
| 4007-051 | 9/1991 | Germany | 294/1.3 |
| 4008-295 | 10/1991 | Germany | 294/1.3 |

*Primary Examiner*—Dean J. Kramer
*Attorney, Agent, or Firm*—McGlew and Tuttle, P.C.

[57] ABSTRACT

A device for bagging an object on a surface with first and second plates that are pivotally connected together on one edge. The first and second wire form extension elements are rotatably connected to another edge of the plates. The extension elements are rotatable between a first position and a second position, where the first position is adjacent to first plate and between the first and second plates. The second position of the wire form extension element has the extension element extending away from the respective plate.

6 Claims, 1 Drawing Sheet

DEVICE FOR THE PICKING UP OF CANINE EXCREMENT

BACKGROUND OF THE INVENTION

The present invention concerns a device for the picking up of organic waste from the ground, in particular canine excrement. The excrement of canines, often left on sidewalks and pavements, on walkways and in general in places where people walk, poses a problem which requires an efficient solution for the protection of city dwellers and the appearance of the environment. In many places education campaigns have been started in this regard and more and more regulations are being imposed to oblige dog owners to pick up the excrement from their animals to maintain the cleanliness of communal areas.

Accordingly, various devices have been proposed for the picking up of canine excrement from the ground, devices which are relatively complicated and cumbersome and often require two hands to use.

SUMMARY AND OBJECTS OF THE INVENTION

The present invention however, concerns the supply of a manageable device for the simple and convenient picking up of canine excrement, involving also the use of a bag, in a most hygienic manner.

A further aim of the invention is to supply a device for the picking up of canine excrement, foldable, as little cumbersome as possible, which can fit directly in the pocket to be easily carried and to be always available for use.

Another aim of the invention is to supply a device which can be efficiently utilised with one hand and with a pincer like gathering action, acting from ground level to collect the excrement from below and of ample capacity given that the collection bag does not obstruct its lateral expansion.

These aims are achieved with a device for the picking up of canine excrement with first and second plates that are pivotally connected together on one edge. The first and second wire form extension elements are rotatably connected to another edge of the plates. The extension elements are rotatable between a first position and a second position, where the first position is adjacent to first plate and between the first and second plates. The second position of the wire form extension element has the extension element extending away from the respective plate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The device proposed here is composed of two plates 11, 12 and two extension wire elements 13, 14 bent into a U or C shape.

The two plates 11 and 12 are hinged together on one edge at 15, allowing both plates to move in a pincer action. These plates can be made of any material such as metal, wood, cardboard or plastic and can be hinged together by means of a separate hinge or an integral one or simply by a bending line. The plates can have an anatomical shape suitable for grasping by hand or can have the slots $\mathbf{11}^1$ and $\mathbf{12}^1$ or some transverse straps to facilitate holding by hand and operating the opening and closing. In addition, the two plates can be put under stress by the use of at least one spring 16 tending to maintain the device in the open position, so that the manual action is only that of closing the device during its use.

Figure 1:
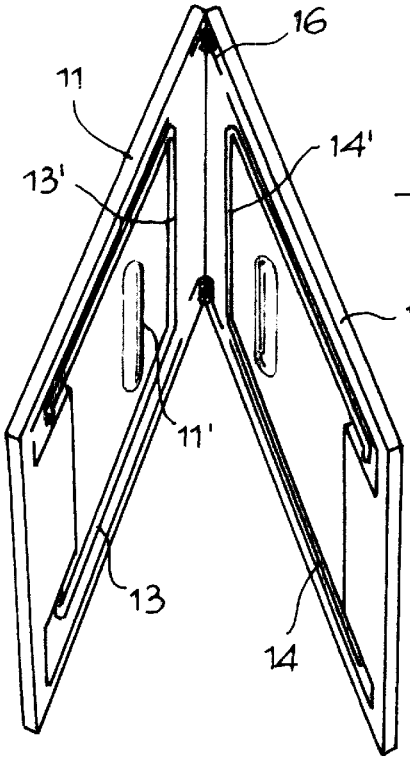
FIG. 1 is a view of the device folded to be carried in the pocket or otherwise.
Figure 2:
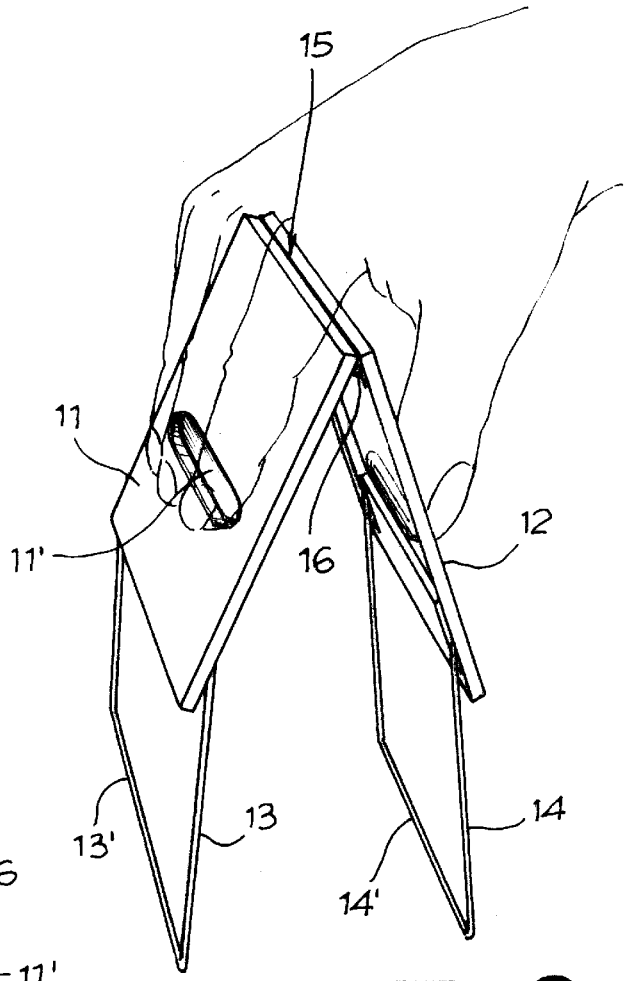
FIG. 2 is a view of the device unfolded ready for use.

The wire elements 13 and 14 are applied to the two plates 11 and 12 on the edges opposite those which are hinged together. These elements 13 and 14 are rotatable with respect to the plates and can be moved from a storing position in the plates—FIG. 1—to a position of use—FIG. 2—as an extension of the plates. When in the first position the wire elements are enclosed in the plates and the resulting device is small enough to be put into the pocket.

When they are unfolded, the plates 11, 12 have a shape to hold the extension elements 13 and 14 at an angle to the plates tending toward each other and the extension elements have at the ends a cross piece $\mathbf{13}^1$ and $\mathbf{14}^1$ acting as scrapers on the ground.

Figure 3:
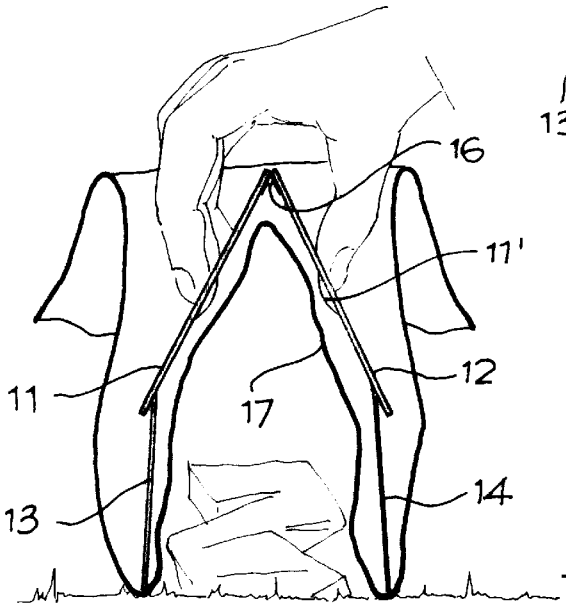
FIG. 3 is a schematic view of the device being used with a collection bag.

To use, the device is taken in one hand by grasping the plates, open and with a collection bag 17 placed between the extension elements with its open end turned back over the external part of the device—FIG. 3—. In this condition, by placing the extension element cross pieces on the ground and closing the device the excrement can be picked up. The bag can also extend beyond the extension elements in this way receiving the material picked up from the ground by the cross pieces $\mathbf{13}^1$ and $\mathbf{14}^1$ being brought together. When this operation of picking up has been completed, the mouth of the bag can be pulled straight to close the bag containing the excrement when released by the device. The device can then be folded up, closed and replaced in the pocket.

While specific embodiments of the invention have been shown and described in detail to illustrate the application of the principles of the invention, it will be understood that the invention may be embodied otherwise without departing from such principles.

I claim:

1. A device for bagging an object on a surface, the device comprising:

first and second plates pivotally connected together on one edge;

a first wire form extension element rotatably connected to another edge of said first plate, said first wire form extension element being rotatable between a first position and a second position, said first position being adjacent said first plate and between said first and second plates, said second position being extended away from said first plate;

a second wire form extension element rotatably connected to another edge of said second plate, said second wire form extension element being rotatable between a first position and a second position, said first position being adjacent said second plate and between said first and second plates, said second position being extended away from said second plate, said first and second plates having a shape to store said first and second wire form extensions inside respective said first and second plates.

2. The device in accordance with claim 1, wherein:

said second position of said wire form extensions are at an angle to respective said plates in a direction toward each other.

3. The device in accordance with claim 1, wherein:

said wire form extensions are in one of a U and a C shape.

4. The device in accordance with claim 1, wherein:

said one edge of said first and second plates is substantially opposite said another edge.

5. The device in accordance with claim 1, wherein:

said second position is greater than 90 degrees and less than 180 degrees from said first position;

said first and second plates have a shape for limiting rotation of said first and second wire form extensions to between said first and second positions;

said second position of said wire form extensions are at an angle to respective said plates in a direction toward each other; said wire form extensions are in one of a U and a C shape:

said one edge of said first and second plates is substantially opposite said another edge.

6. A device for bagging an object on a surface, the device comprising:

first and second plates pivotally connected together on one edge;

a first wire form extension element rotatable connected to another edge of said first plate, said first wire form extension element being rotatable between a first position and a second position, said first position being adjacent said first plate and between said first and second plates, said second position being extended away from said first plate;

a second wire form extension element rotatable connected to another edge of said second plate, said second wire form extension element being rotatable between a first position and a second position, said first position being adjacent said second plate and between said first and second plates said second position being extended away from said second plate said second position being greater than 90 degrees and less than 180 degrees from said first position, said first and second plates having a shape for limiting rotation of said first and second wire form extensions to between said first and second positions.

* * * * *